US011147997B2

(12) United States Patent
Priest et al.

(10) Patent No.: US 11,147,997 B2
(45) Date of Patent: Oct. 19, 2021

(54) EXERCISE JUMPER

(71) Applicant: M&M Sales Enterprises Inc., Dubuque, IA (US)

(72) Inventors: John Brian Priest, Dubuque, IA (US); Ryan J. Fens, Dubuque, IA (US)

(73) Assignee: M&M Sales Enterprises Inc., Dubuque, IA (US)

( * ) Notice: Subject to any disclaimer, the term of this patent is extended or adjusted under 35 U.S.C. 154(b) by 119 days.

(21) Appl. No.: 16/688,990

(22) Filed: Nov. 19, 2019

(65) Prior Publication Data

US 2020/0086155 A1 Mar. 19, 2020

Related U.S. Application Data

(63) Continuation-in-part of application No. 15/806,260, filed on Nov. 7, 2017, now Pat. No. 10,537,762.

(51) Int. Cl.
*A63B 5/16* (2006.01)

(52) U.S. Cl.
CPC ..... *A63B 5/166* (2013.01); *A63B 2208/12* (2013.01); *A63B 2225/62* (2013.01)

(58) Field of Classification Search
CPC . A63B 5/00–22; A63B 5/166; A63B 2208/12; A63B 2225/62; A63B 71/023; A63B 2071/024; A63B 71/022; A63B 71/0054; A63B 2225/093; A63B 2210/00
See application file for complete search history.

(56) References Cited

U.S. PATENT DOCUMENTS 1,486,669 A 3/1924 Kline
D160,419 S * 10/1950 Packer ..... A63B 5/00 D21/826
3,130,816 A 4/1964 Wright
3,167,312 A * 1/1965 Blanchard ..... A63B 25/08 482/128
3,195,890 A * 7/1965 Salls ..... A63B 25/08 482/128
3,408,070 A 10/1968 Gonzales
3,627,314 A * 12/1971 Brown ..... A63B 5/166 482/77
3,671,988 A * 6/1972 Newman ..... A63B 25/08 441/65
3,716,229 A * 2/1973 Van Der Cleyen ..... C04B 35/80 482/77
3,765,673 A * 10/1973 Daw ..... A63B 25/08 482/26
D256,107 S * 7/1980 Mitchener ..... A63B 25/08 D11/148
4,370,073 A * 1/1983 Ohme ..... E04B 1/19 403/172

(Continued)

*Primary Examiner* — Andrew S Lo
(74) *Attorney, Agent, or Firm* — Rathe Lindenbaum LLP

(57) ABSTRACT

A jumper apparatus may include a ring, a set of poles along the ring and a pneumatic tube. Each pole of the set of poles may have a first axial end portion inwardly extending towards a centerline of the ring, a second axial end portion outwardly extending away from the centerline of the ring and a vertical portion connecting the first axial end portion and the second axial end portion. The ring is vertically located between the first axial end portion and the second axial end portion of each pole. The pneumatic tube may extend about the set of poles over the second axial end portion of each pole.

20 Claims, 11 Drawing Sheets

(56) References Cited

U.S. PATENT DOCUMENTS

| | | | | | |
|---|---|---|---|---|---|
| 4,438,919 | A * | 3/1984 | Gamzo | A63B 69/0022 | 280/87.03 |
| 4,598,905 | A | 7/1986 | Vrana | | |
| 4,836,530 | A | 6/1989 | Stanley, Jr. | | |
| 5,361,794 | A * | 11/1994 | Brady | E04H 15/48 | 135/147 |
| D361,604 | S * | 8/1995 | Stroppiana | D21/413 | |
| 5,613,922 | A | 3/1997 | Hsiang | | |
| 5,921,899 | A | 7/1999 | Rose | | |
| 6,679,811 | B2 | 1/2004 | Chen | | |
| D540,887 | S * | 4/2007 | Goldman | D21/413 | |
| 8,246,521 | B2 | 8/2012 | Alexander | | |
| 9,033,853 | B1 * | 5/2015 | McMurtrey | A63B 5/00 | 482/35 |
| D745,618 | S * | 12/2015 | McMurtrey | E04H 15/48 | D21/797 |
| 9,260,881 | B2 * | 2/2016 | Lamke | E04H 15/48 | |
| D798,982 | S * | 10/2017 | O'Brien | A63B 25/08 | D21/797 |
| 2003/0064861 | A1 | 4/2003 | Chen | | |
| 2014/0109947 | A1 * | 4/2014 | Choi | E04H 15/48 | 135/144 |
| 2014/0202512 | A1 * | 7/2014 | Jin | E04H 15/46 | 135/140 |

* cited by examiner

EXERCISE JUMPER

CROSS-REFERENCE TO RELATED APPLICATIONS

The present application is a continuation-in-part patent application claiming priority under 35 USC section 120 from co-pending U.S. patent application Ser. No. 15/806,260 filed on Nov. 7, 2017 by John Brian Priest and entitled JUMPER, the full disclosure of which is hereby incorporated by reference.

BACKGROUND

Innovations in exercise equipment for children have accelerated in recent years to encourage children to exercise. The new innovations in exercise equipment combine fun and exercise in a limited space. Providing exercise equipment that is compact, safe and economical continues to present an ongoing challenge.

DETAILED DESCRIPTION OF EXAMPLES

Figure 1:
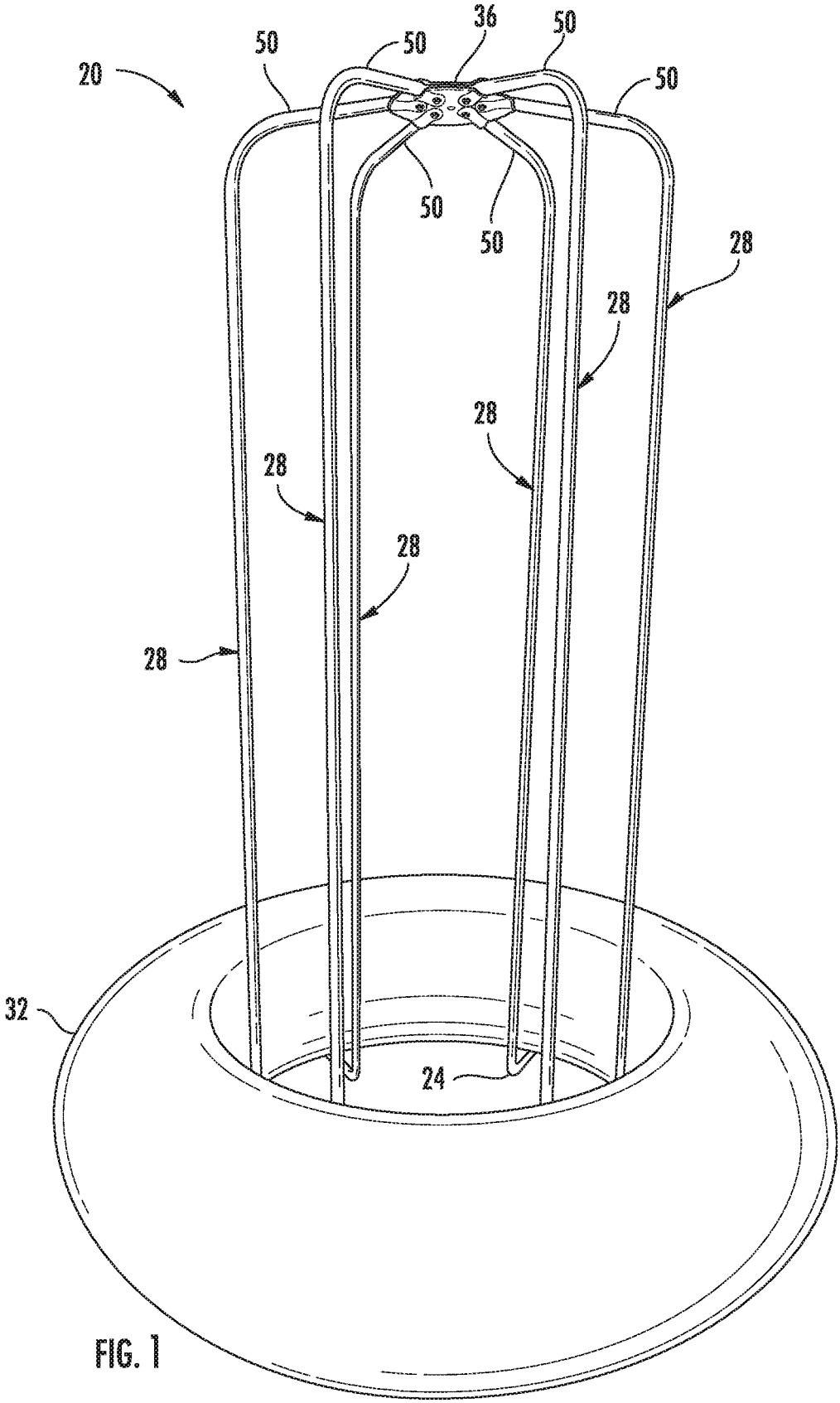
FIG. 1 is a top perspective view of an example jumper.

FIG. 1 illustrates an example piece of exercise equipment in the form of a jumper 20. Jumper 20 facilitates exercise by allowing a child or other user to use jump on an underlying springy surface in a controlled manner in a limited space. As will be described hereafter, jumper 20 is compact, safe and economical. Jumper 20 comprises base 24, poles 28, pneumatic tube 32 and cap 36.

Base 24 supports jumper 20 on an underlying surface or ground. Base 24 further supports poles 28. Poles 28 are coupled to base 24 and stand upright from base 24. Base 24 underlies pneumatic tube 32 while poles 28 extend through the center or interior of pneumatic tube 32, inhibiting or restricting sideways movement of pneumatic tube 32. Poles 28 further provides surfaces by which a person jumping on pneumatic tube 32 may hold or grip to retain their balance and maintain control during jumping. In the example illustrated, jumper 20 comprises six equidistantly spaced poles 28 extending in a circle about a centerline of jumper 20. In the example illustrated, the circle about which poles 28 extend has a diameter of at least 4 inches and no greater than 50 inches, and in one implementation no greater than 20 inches. This diameter drives a spacing between poles 28, a spacing that provide adequate space for multiple persons to jump and securely retaining pneumatic tube 32 in place. In other implementations, jumper 20 may have a greater or fewer number of such poles 28 extending from base 24. In other implementations, the diameter of the overall circle about which poles 28 extend or circumscribe may be larger or smaller.

Pneumatic tube 32 comprises a tube inflated with a gas, such as air, that has a general donut-shape. When inflated, tube 32 provides a springy upper surface upon which a person may stand and bounce. Tube 32 is sized such that the interior surfaces bear against poles 28 and such that tube 32 overlies base 24. As a result, pneumatic tube 34 is retained securely in place.

Figure 2:
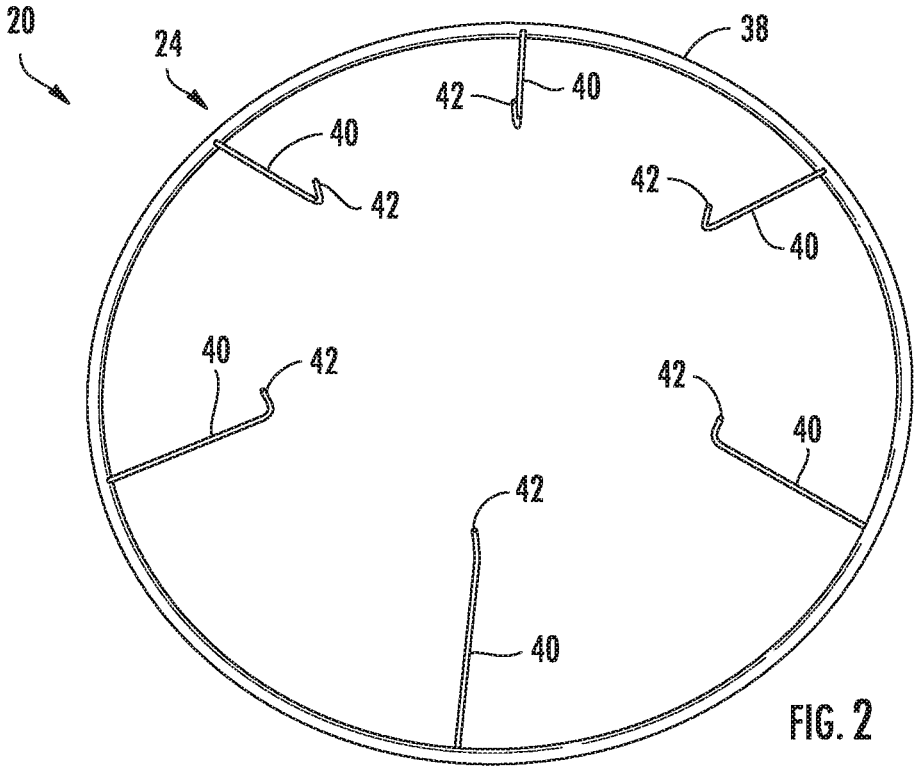
FIG. 2 is a top perspective view of an example base of the jumper of FIG. 1.

FIG. 2 illustrates base 24 in greater detail. As shown by FIG. 2, base 24 comprises an annular tubular ring 38 and inwardly extending spokes 40, the number of spokes 40 corresponding to the number of poles 28 (shown in FIG. 1). Each spoke 40 extends from the tubular ring 38 and has an upturned end 42 for being received within a hollow interior of an end of its associated pole 28. Each spoke 40 has a length less than a width of pneumatic tube 32 such that pneumatic tube 32 projects beyond ring 38 when spokes 40 are underlying pneumatic tube 32. In other implementations, each spoke 40 has a length greater than a width of pneumatic tube 32 such that portions of base 24 projects beyond the outer periphery of pneumatic tube 32.

Upturned ends 42 form the circle about which poles 28 extend. The upturn ends 42 are located along a circle having a diameter that is less than a diameter of the central opening of pneumatic tube 32. Upturned ends 42 facilitate securement and retention of poles 28. In other implementations, upturned ends 42 may be replaced with hollow sleeves that receive and portions of poles 28. In still other implementations, upturned ends 42 may be replaced with other mounting structures that facilitate securement to poles 28 to retain poles 28 in an upright orientation.

In the example illustrated, base 24 is formed from multiple individual arcuate segments which are releasably or removably secured to one another. In one implementation, the individual our quit segments are snapped to one another. For example, in one implementation, one end of each segment has a resiliently outwardly biased pin or button supported by a smaller projection which is sized so as to be received within the hollow interior oven and end of an adjacent segment has a detent or bore, wherein the button pops are snapped into the bore or detent when the projection is received within the bore. In one implementation, each arcuate segment has the detent or bore on a first end and the projection with the spring biased button on a second end. In another implementation, base 24 is formed from multiple alternating segments, where one segment has detents or bores on both ends and where and adjacent segment has a projection with the spring biased button on both ends. In yet other implementations, the multiple segments forming base 24 may be interconnected to one another in other fashions. In some implementations, base 24 may not be segmented, but they be a continuous integral ring.

In one implementation, spokes 40 are welded or otherwise permanently affixed to ring 38 or their respective segments forming ring 38. In yet another implementation, the tubular tubes forming ring 38 may include internally threaded bores by which externally threaded and portions of spokes 40 may be screwed into and secured to the tubular tubes forming ring 38.

Figure 3:
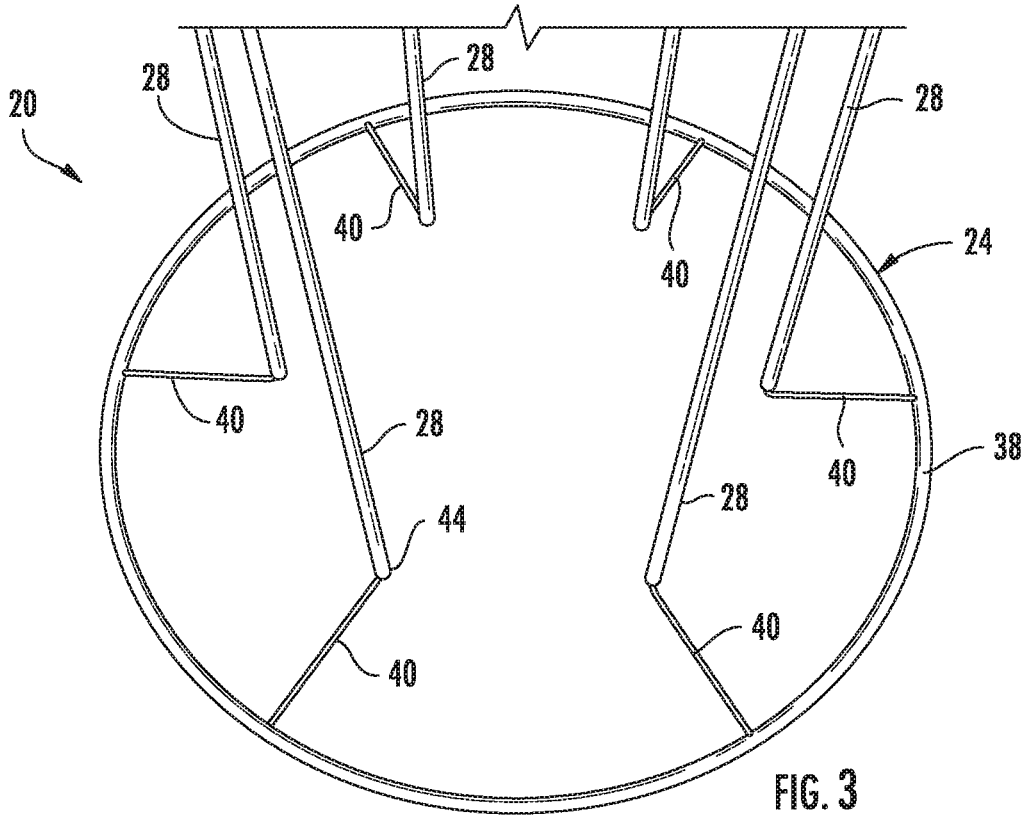
FIG. 3 is a top perspective view of the base of FIG. 2 secured to example poles of the jumper of FIG. 1.
Figure 4:
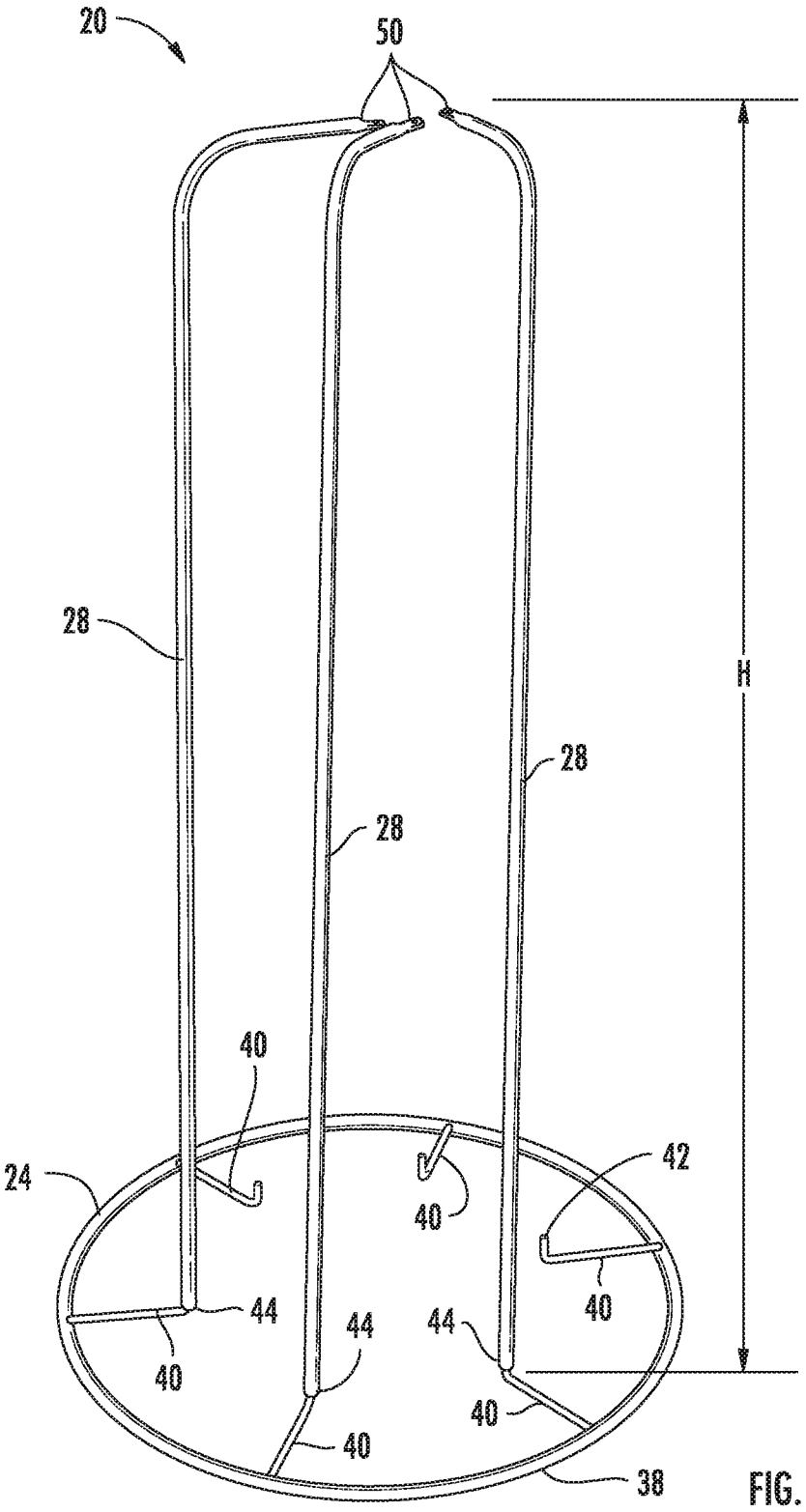
FIG. 4 is a perspective view of the poles secured to the base.

FIGS. 3 and 4 illustrate poles 28 in greater detail. As shown by FIG. 3, each of poles 28 has a hollow end portion 44 that receives an upturned and 42 of a corresponding spoke 40. In one implementation, upturn ends 42 simply slide into the hollow interior of end portion 44. In another implementation, upturn and 42 are externally threaded while the end portions 44 are internally threaded, facilitating screwing of poles 28 onto upturn ends 44. In yet other implementations, upturn ends 42 carry a resiliently outwardly biased pushbutton that snaps into a corresponding detent or opening in end portion 44.

As shown by FIG. 4, each of poles 28 has an axial end portion 50. Each axial end portion 50 is received and retained within cap 36 (shown in 1). Each of poles 28 has a height H (the distance from the axial end of pole 28 to the inward bending of the pole so as to form end portion 50) of at least 4 feet and as much as 10 feet to accommodate a wide range of different persons having different heights. In other implementations, the height may be smaller when accommodating a specific height or age range of users, depending upon the height and age of the persons who are to use jumper 20.

In the example illustrated, each of poles 28 is formed from multiple segments which are releasably secured to one another. For example, in one implementation, adjacent segments of a pole 28 have an internally threaded bore and an externally threaded mail projection screwed into the internally threaded bore. In other implementations, different segments of each pole 28 may be releasably connected to one another in other fashions. In yet other implementations, each pole 28 may be a continuous integral unitary pole being segmented.

As shown by FIG. 1, cap 36 joint interconnects the axial end portions 50 of each of poles 28. Cap 36 joins such end portions 50 of each of poles 28 in a reliable and secure manner. Cap 36 facilitates easy interconnection of poles 28 at a low cost. Cap 36 achieves such reliable interconnection and securement through the use of radially extending grooves that receive axial end portions 50 of poles 28. As will be described hereafter, the grooves surround poles 28 to securely retain such poles 28 and inhibit movement of poles 28.

Figure 5:
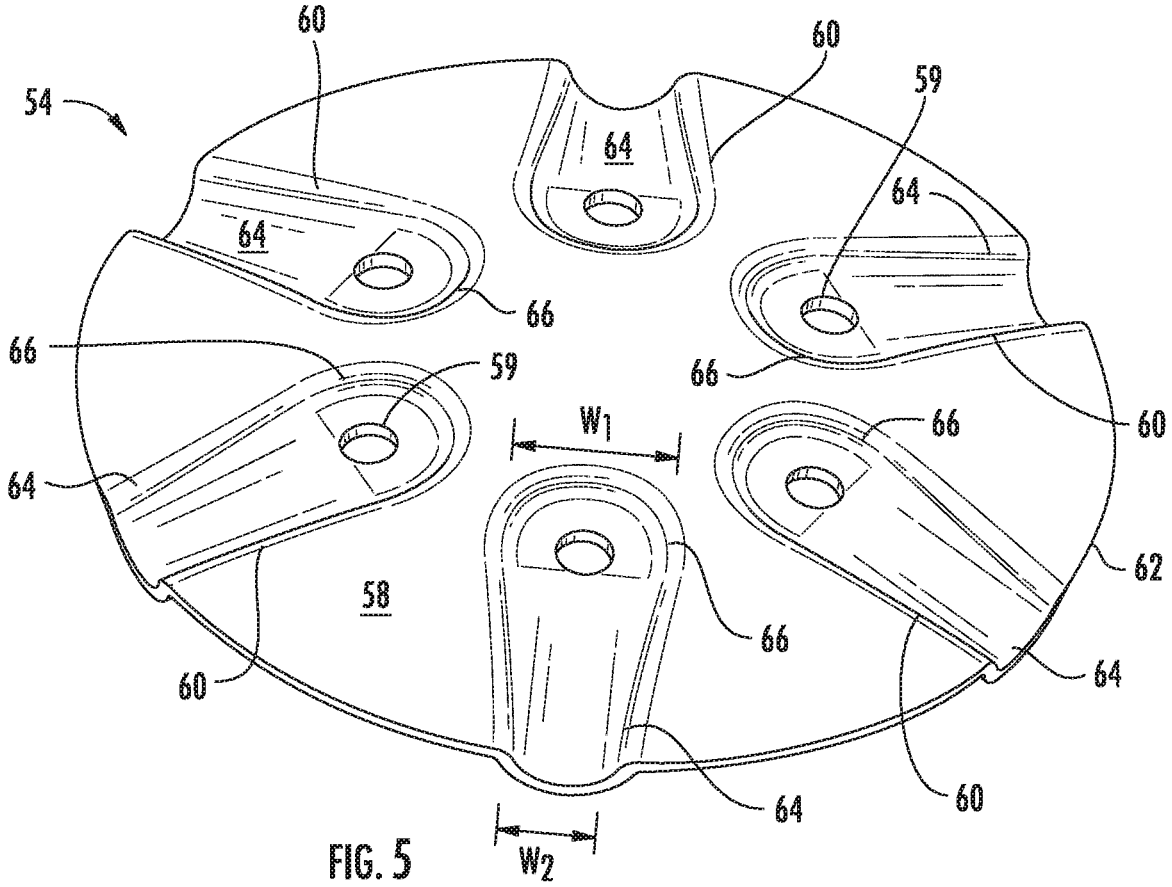
FIG. 5 is a top perspective view of an example lower plate of an example cap of the jumper of FIG. 1.
Figure 6:
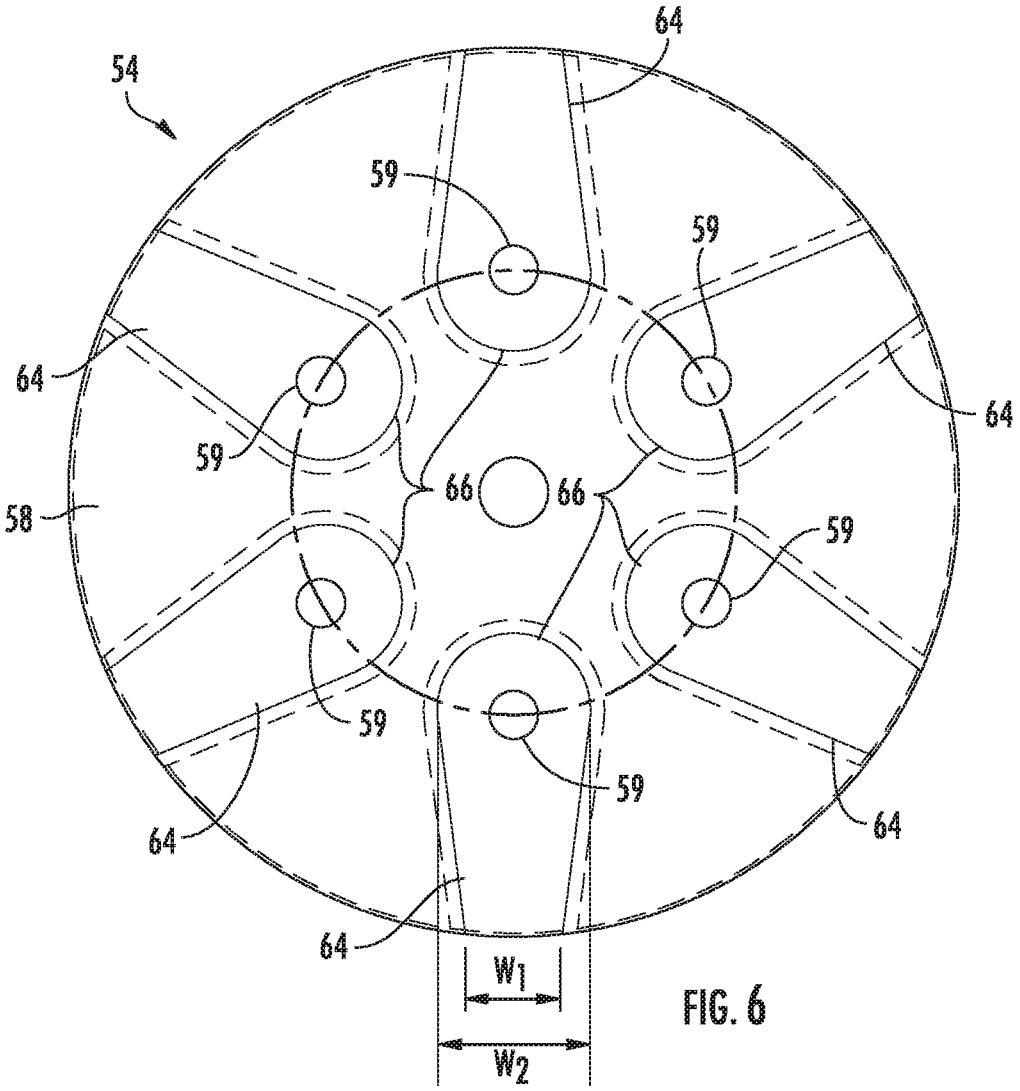
FIG. 6 is a top view of the lower plate of FIG. 5.
Figure 7:
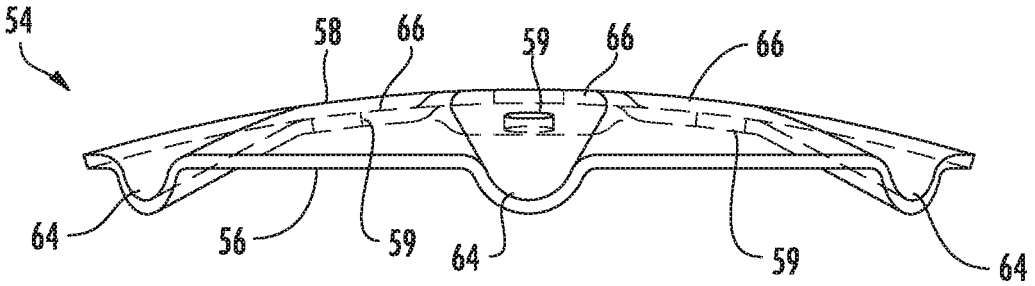
FIG. 7 is a side view of the lower plate of FIG. 5.

In the example illustrated, cap 36 is formed from two halves, a top half and a bottom half, which are joined to one another, sandwiching end portions 50 therebetween within the radially extending grooves. FIGS. 5-7 illustrate an example lower plate 54 which forms a lower half of cap 36. Lower plate 54 comprises a circular disk having a concave lower face 56, a convex upper face 58 and openings 59. Convex upper face 58 comprises a series of circumferentially spaced grooves 60 that extend radially from a peripheral edge 62 of plate 54 towards a center point of plate 54. Grooves 60 are spaced by intervening web portions 61. Each of grooves 60 comprises a rounded interior portion 64 and a flattened interior portion 66. Rounded interior portion 64 extends from periphery 62 to flattened interior portion 66. Rounded interior portion 64 is shaped to receive a lower rounded portion of a received end portion 50 of a pole 28.

Flattened interior portion 66 is located radially inward of rounded interior portion 64. Flattened interior portion 66 is shaped to receive a flattened end portion of a received end portion 50 of a pole 28. As further shown by FIGS. 5 and 6, flattened interior portion 66 has a width W1 that is greater than a width W2 of the rounded interior portion 64 that leads to the flattened interior portion 66. As will be described hereafter, this shape and the corresponding shape of end portion 50 radially lock end portion 50 in place.

Openings 59 extend through plate 54. Openings 59 are located within each flattened interior portion 66. As will be described hereafter, openings 59 facilitates the insertion of fasteners there through, wherein the fasteners secure lower plate 54 to an upper plate (shown in FIGS. 8 and 9). Such fasteners further extend through end portions 50 of poles 28.

Figure 8:
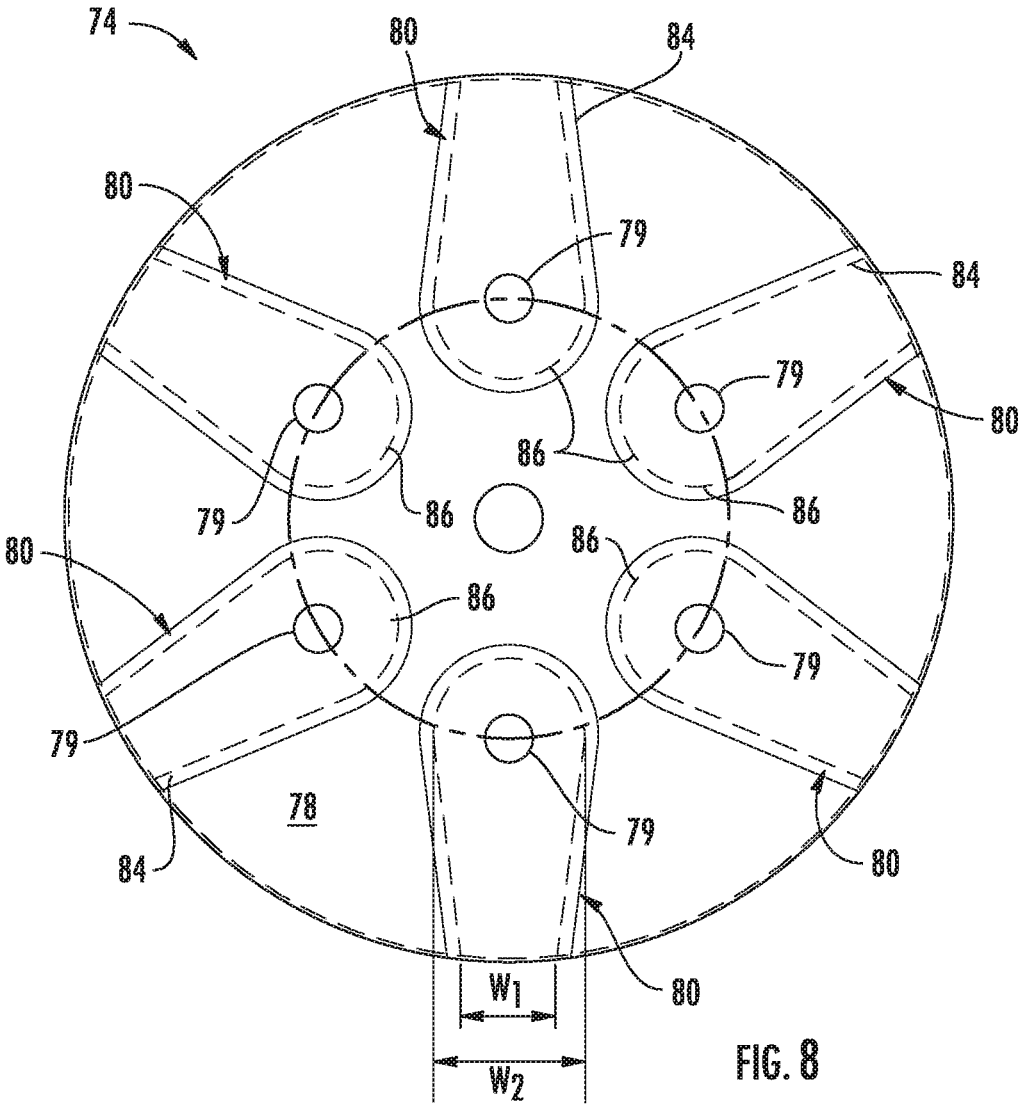
FIG. 8 is a top view of an example upper plate of the cap of the jumper of FIG. 1.
Figure 9:
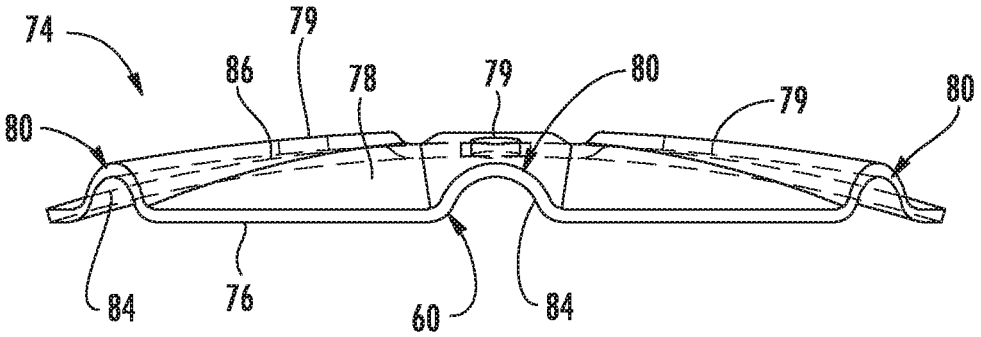
FIG. 9 is a side view of the upper plate of FIG. 8.
Figure 15:
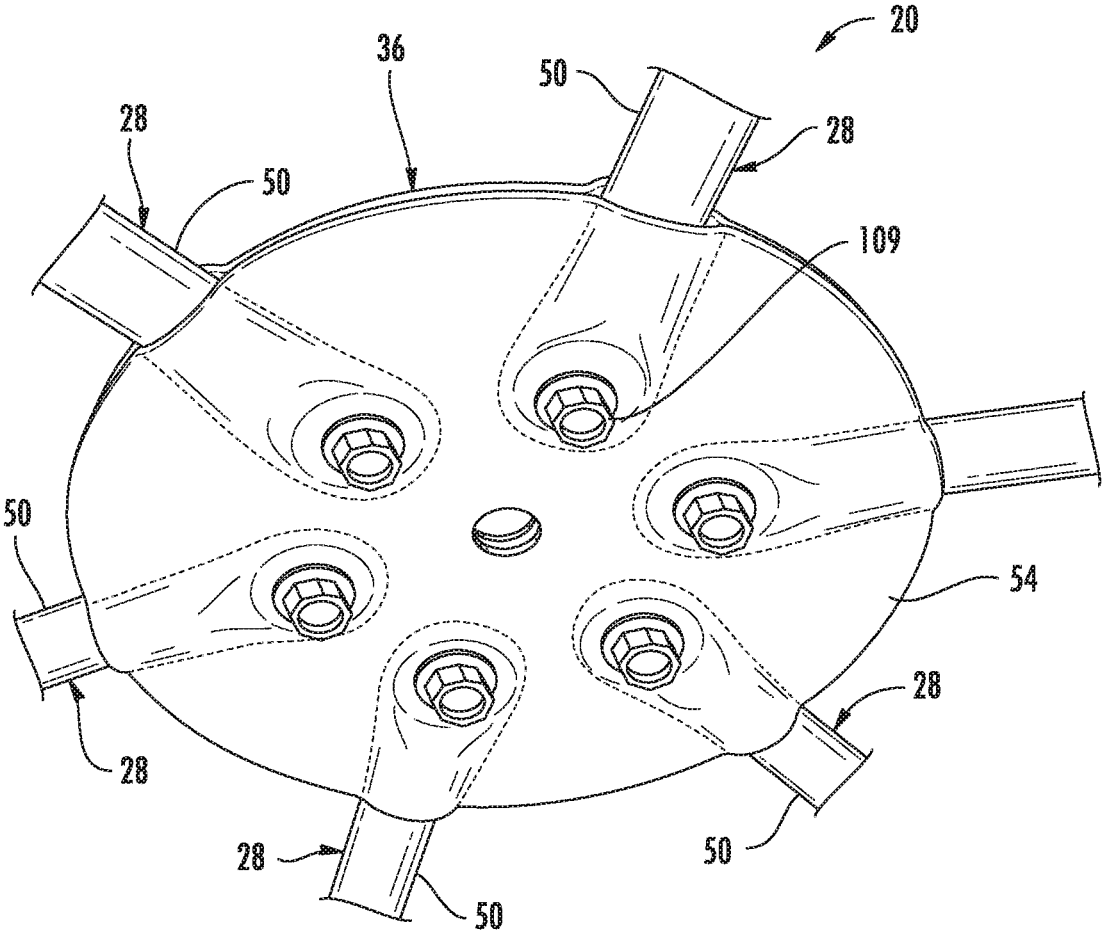
FIG. 15 is a bottom perspective view of the jumper of FIG. 1, illustrating the cap receiving and retaining end portions of each of the poles.

FIGS. 8 and 9 illustrate an example upper plate 74 forming a top half of cap 36. Upper plate 74 cooperates with lower plate 54 to sandwich and portion 50 of each of poles 28 therebetween. Upper plate 74 mirrors lower plate 54 except that the grooves are formed in a lower face of upper plate 74. Upper plate 74 comprises a circular disk having a concave lower face 76, a convex upper face 78 and openings 79. Convex upper face 78 comprises a series of circumferentially spaced grooves 80 that extend radially from a peripheral edge 82 of plate 74 towards a center point of plate 74. Grooves 80 are spaced by intervening web portions 81. As shown by FIG. 15, the web portions 81 lay flat against and are in abutting contact with web portions 61. Each of grooves 80 comprises a rounded interior portion 84 and a flattened interior portion 86. Rounded interior portion 84 extends from periphery 82 to flattened interior portion 86. Rounded interior portion 84 is shaped to receive a lower rounded portion of a received end portion 50 of a pole 28.

Flattened interior portion 86 is located radially inward of rounded interior portion 84. Flattened interior portion 86 is shaped to receive a flattened end portion of a received end portion 50 of a pole 28. As further shown by FIG. 8, flattened interior portion 86 has a width W1 that is greater than a width W2 of the rounded interior portion 84 that leads to the flattened interior portion 86. As will be described hereafter, this shape in the corresponding shape of end portion 50 radially locks end portion 50 in place.

Openings 79 extend through plate 74. Openings 79 are located within each flattened interior portion 86 and are located so as to be aligned with openings 59. As will be described hereafter, openings 79 facilitates the insertion of fasteners therethrough, wherein the fasteners secure lower plate 54 to upper upper plate 74 such that fasteners further extend through end portions 50 of poles 28.

In the example illustrated, the slight dome-shape of plates 54 and 74 facilitates a slight slope or upward angle of end portions 50 of poles 28 (shown in FIG. 1). As a result, sharp corners or turns are avoided. In other implementations, plates 54 and 74 may be flat where end portions 50 of poles 28 perpendicularly extend from the vertical portions of poles 28 or may have an inverted dome shape where end portions 50 of poles 28 form an acute angle with the vertical portions of poles 28.

Figure 10:
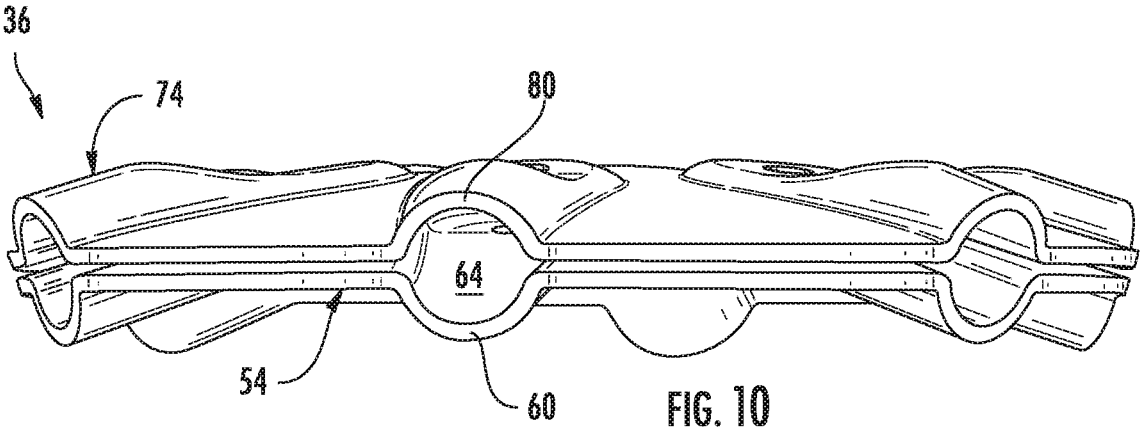
FIG. 10 is a side view of the lower plate of 5 and the upper plate of FIG. 8 together to form a cap of the example jumper.
Figure 11:
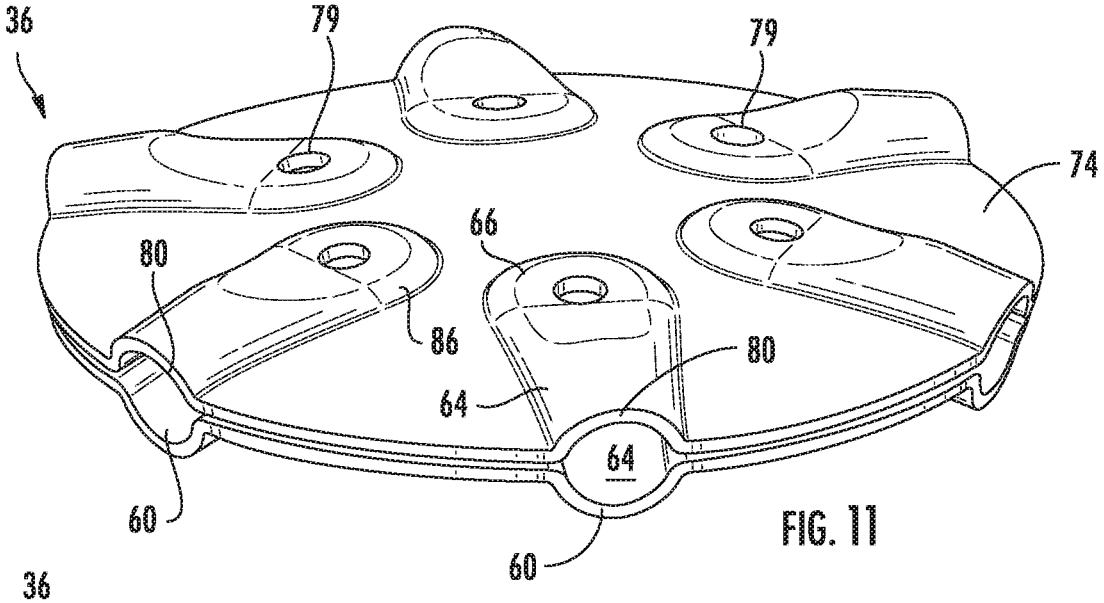
FIG. 11 is a top perspective view of the cap of FIG. 10.
Figure 12:
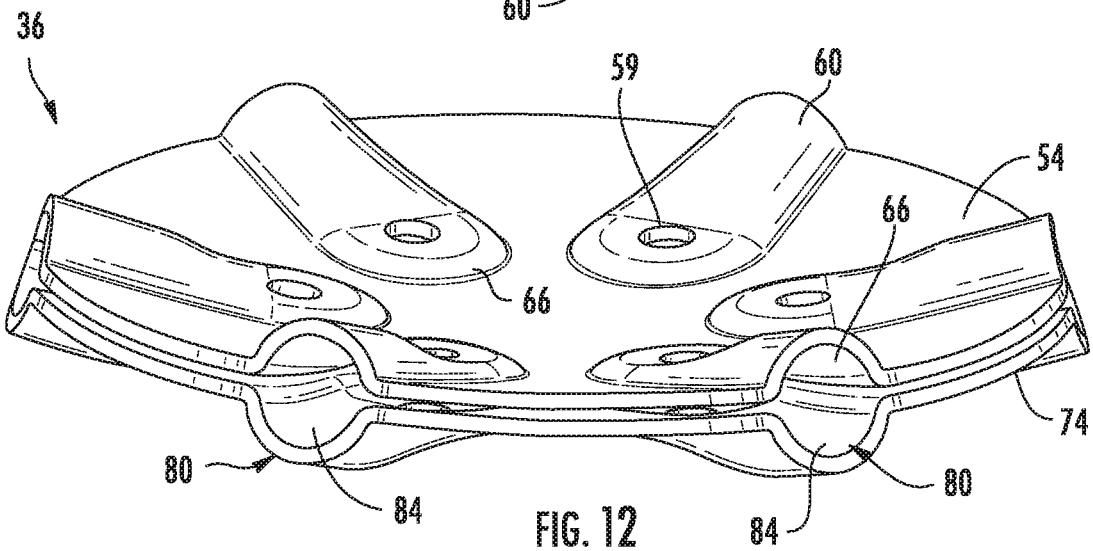
FIG. 12 is a bottom perspective view of the cap of FIG. 10.

FIGS. 10-12 illustrate how plates 54 and 74 mate together to form cap 36. 10 and 12 illustrate 36 prior to the insertion of end portions 50 of posts 28 and prior to insertion of fasteners that secure plates 54 and 74 together with post 28 fastened therebetween. As shown by FIGS. 10-12, surfaces between grooves 60, 80 are held in close conformal abutting contact.

Figure 13:
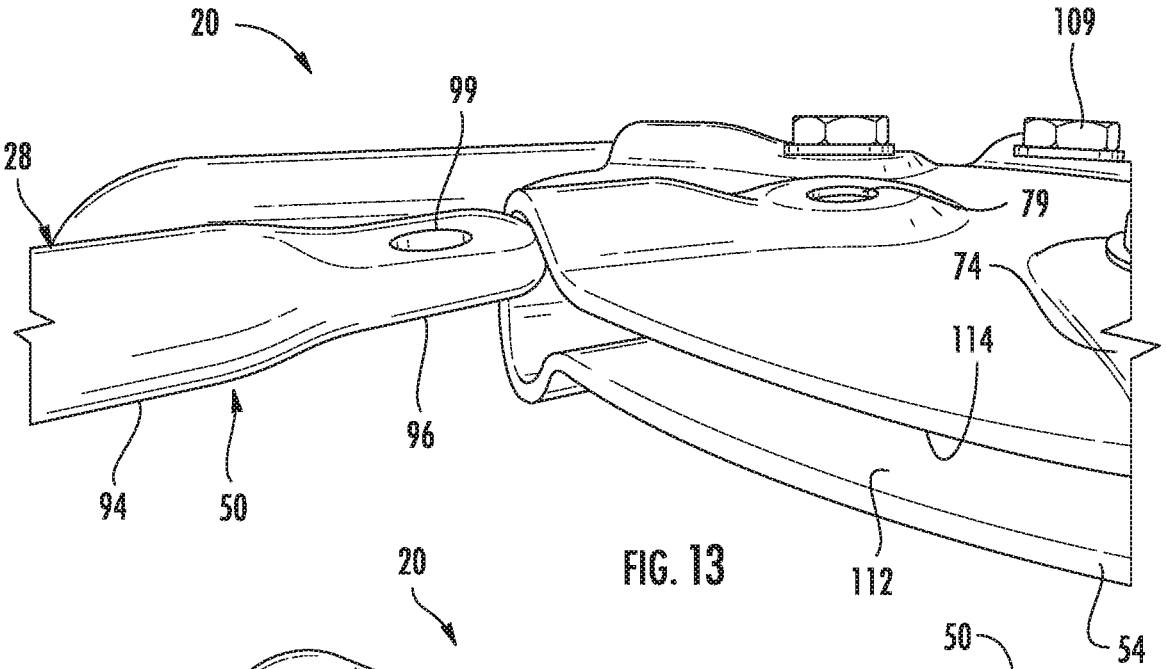
FIG. 13 is a perspective view of the jumper of 1 illustrating assembly of end portions of the poles into the cap.
Figure 14:
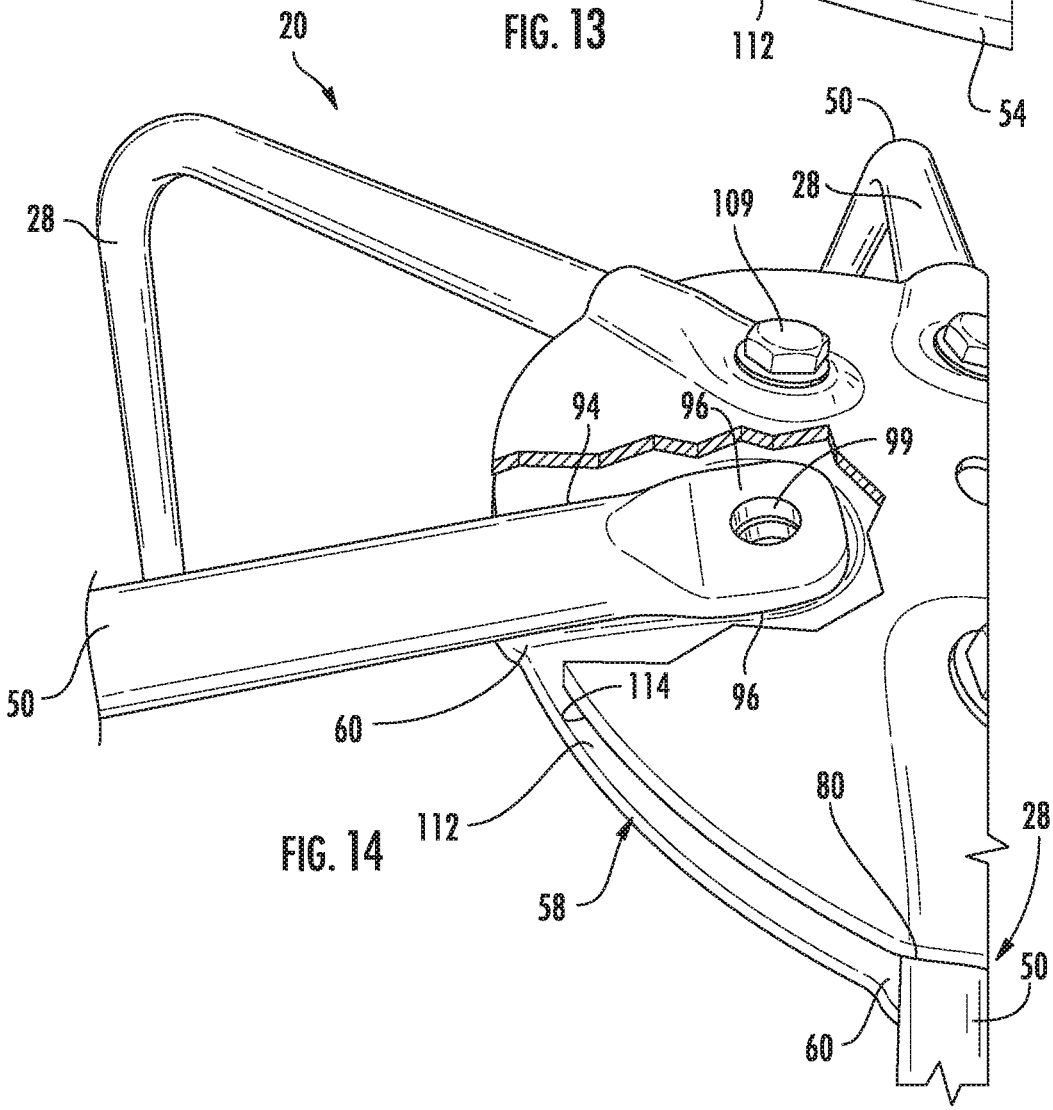
FIG. 14 is a perspective view illustrating receipt of an end portion of one of the poles into the cap.

FIGS. 13-15 illustrate the assembly of poles 28 to cap 36. As shown by FIGS. 13 and 14, each of end portions 50 of each of poles 28 have a rounded portion 94, a flattened portion 96 and an opening 99. Opening 99 extends through flattened portion 96. Opening 99 is located so as to be aligned with openings 59 and 79 when rounded portion 94 is received within rounded portion 64 and 84 and when flattened portion 96 is received within flattened portions 76, 96.

In the example illustrated, rounded portion 94 has an outer diameter corresponding to or less than a sum of the depths of rounded portions 64 and 84. Likewise, flattened portion 96 has a thickness corresponding to or less than a sum of the depths of flattened portions 66 and 86. As a result, as shown by FIG. 14, rounded portion 94 and flattened portion 96 snugly fit within grooves 60, 80 between plates 54 and 74. As a result, plates 54 and 74 may be held in conformal contact with one another by fasteners 109 which pass through openings 59, 79 and 99. In the example illustrated, each of fasteners 109 comprises a bolt, a washer and a nut to facilitate tightening of plates 54, 74 about and against end portions 50 of poles 28. In other words, portions 112 of upper face 58 a lower plate 54 are in abutting contact with portions 114 of lower face 78 of upper plate 74 (portions of such plates 54, 74 that extend between and around grooves 60, 80) to provide secure retention of end portions 50 of poles 28.

As further shown by FIG. 14, because flattened portion 96 is received within flattened portions 66, 86 and has a width that is greater than the width W2 of each of rounded portion 66, 86, end portion 50 cannot be pulled out of from between plates 54, 74 and is radially locked in place when plates 54, 74 are secured to one another about end portions 50 by fasteners 109. In the example illustrated, end portion 50 has a shape corresponding to or matching the shape of each of grooves 60, 80 such that grooves 60, 80, when positioned opposite to one another, encapsulate and abut the entire exterior surface of the received end portion 50.

In other implementations, the diameter of rounded portion 94 and/or the thickness of flattened portion 96 may be greater than the combined depth of rounded portions 64, 84 or flattened portions 66, 86, respectively, wherein plates 54, 74 are spaced apart from one another. In the example illustrated, plates 54 and 74 each have rounded portions and flattened portions of their respective grooves 60, 80 such that each of plates 54, 74 assists in radially and circumferentially securing and portions 50 in place. In other implementations, the grooves provided by cap 36 may be applied by a single one of the two plates, wherein the other of the two plates caps the groove provided in whole by the other plate. For example, upper surface of lower plate 54 or the lower surface of upper plate 74 may be flat plates or dome shaped plates, wherein the groove that receives end portion 50 is larger and wherein the opposite plate lacking such a groove caps the groove of the other plate.

FIG. 15 illustrates the underside of cap 36 with each of the poles 28 secured in place by cap 36. Once assembled, cap 36 circumferentially and radially retains each of end portions 50 in place. Cap 36 provides poles 28 with enhanced stability. At the same time, cap 36 covers and conceals end portions of poles 28, reducing the presence of corners or edges. Cap 36 facilitates proper alignment of positioning of poles 28 relative to one another.

Figure 16:
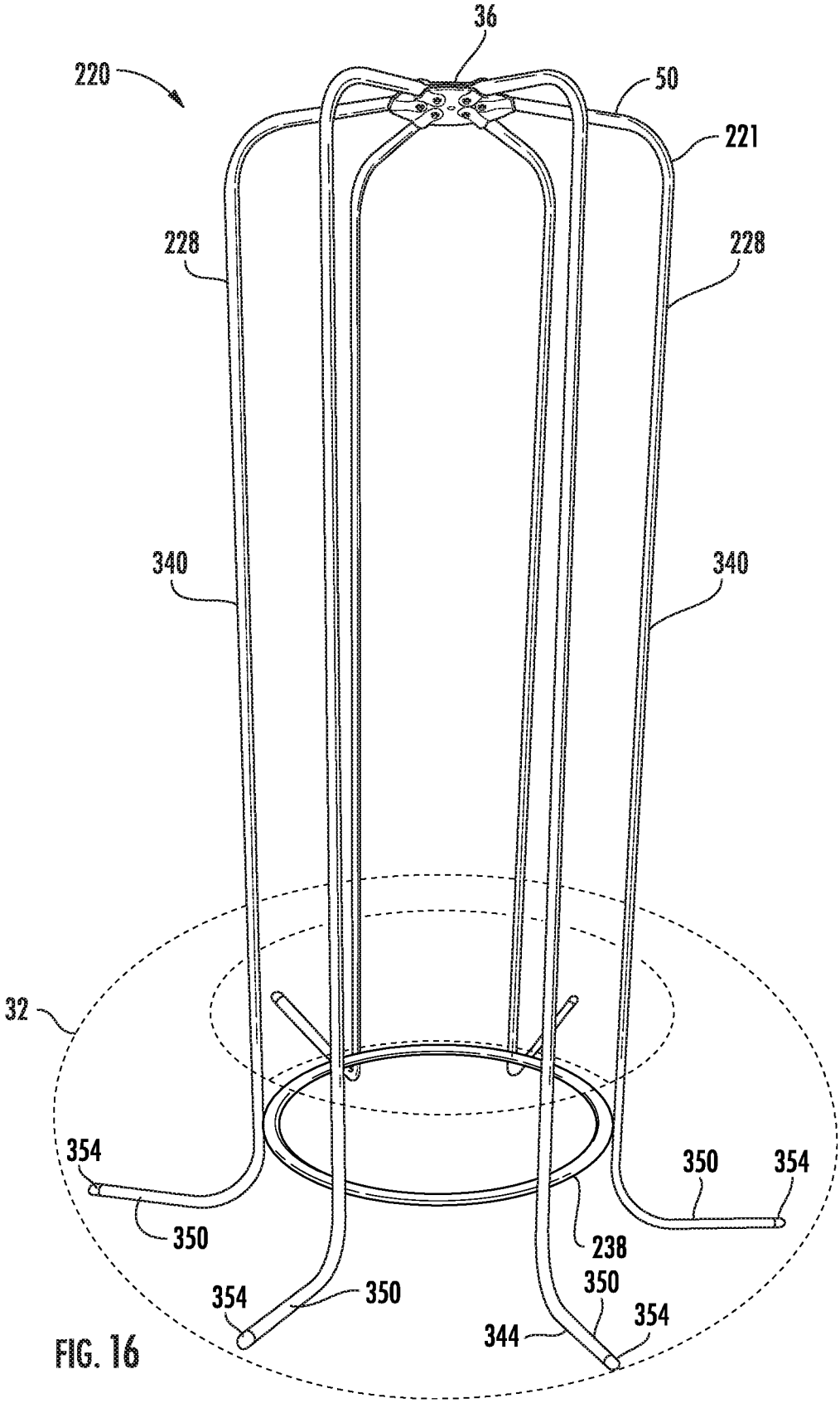
FIG. 16 is a perspective view of an example jumper.
Figure 17:
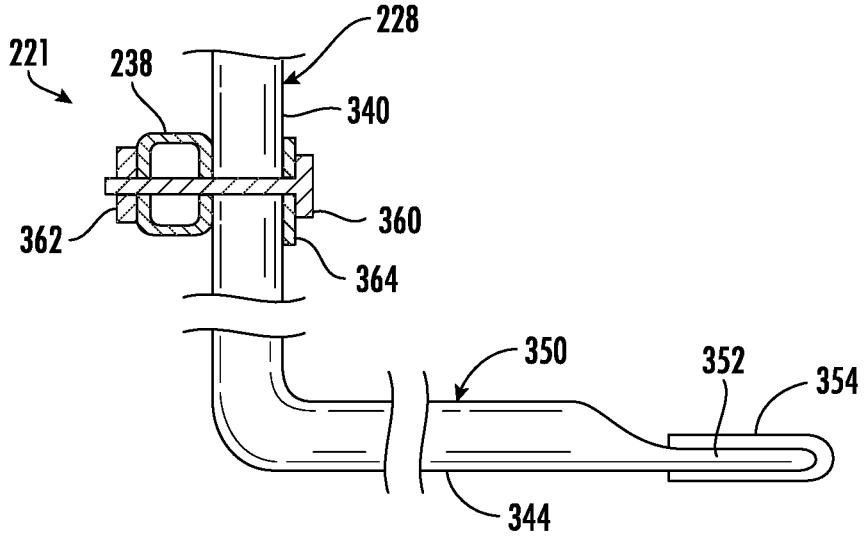
FIG. 17 is an enlarged fragmentary view of portions of the example jumper of FIG. 16 with selected portions shown in section.

FIGS. 16 and 17 illustrates an example piece of exercise equipment in the form of a jumper 220. Jumper 220 facilitates exercise by allowing a child or other user to use jump on an underlying springy surface in a controlled manner in a limited space. As will be described hereafter, jumper 220 is compact, safe and economical. Jumper 220 is similar to jumper 20 described above except that jumper 220 omits base 24, comprises poles 228 in place of poles 28 and additionally comprises ring 238. The remaining components of jumper 220 which correspond to components of jumper 20 are numbered similarly and/or are shown in FIGS. 1-15. FIG. 16 illustrates jumper 220 with pneumatic tube 32 shown transparently to better illustrate remaining portions of jumper 220 which form a frame 221 for jumper 220, wherein a lower portion of the frame 221 locates and retains tube 32. FIG. 17 is an enlarged view of the lower portion of frame 221 with portions shown in section.

Poles 228 comprise axial end portions 50 (described above), vertical portions 340 and axial end portions 344. Vertical portions 340 extend from end portions 50 to axial end portion 344. Vertical portions 340 extend generally perpendicular to end portions 50 and 344. Vertical portions 340 extend parallel to one another along ring 238.

End portions 344 outwardly extend away from the centerline of ring 238 (in contrast to end portions 50 which inwardly extend toward the centerline of ring 238). End portions 344 form feet 350 which are to extend across lie upon underlying support surface. Feet 350 further underlie lower surfaces of the tube 32 (shown in FIG. 16). End portions 344 serve as a base for frame 221 and jumper 220, stabilizing jumper 220. In one implementation, end portion 344 each have a length, that is generally horizontal, of at least 12 inches. In the example illustrated, each end portion 344 has a length less than the width of tube 32 such are not project beyond an outer periphery of tube 32. In other implementations, and portion 344 have a length greater than the width of tube 32, projecting beyond tube 32.

In the example illustrated, each of feet 350 includes a flattened end portion 352, a flattened portion of the tube forming vertical portion 340 and the foot 350 of each pole 228. The flattened portion provides a gradual transition to the underlying support surface, reducing the occurrence of sharp or abrupt edges.

In the example illustrated, each of poles 228 further comprises an end cap 354 which receives and surrounds the corresponding flattened end portion 352. In one implementation, each end cap 354 may comprise a rubber or polymeric sleeve that receives a corresponding flattened end portion 352. In other implementations, endcap 354 may be omitted.

Ring 238 comprises a structure interconnecting each of poles 228. In one implementation, ring 238 comprises a metal ring. In another implementation, ring 238 may be formed from a polymer or other materials.

Ring 238 is located closer to end portion 344 as compared to end portions 50. Each of vertical portion 340 may have a vertical midpoint between end portions 344 and 50, wherein ring 238 is located between the vertical midpoint and end portions 344. Ring 238 structurally strengthens and stabilizes lower regions of each of vertical portions 340 and further stabilizes end portions 344 which form feet 350.

In one implementation, ring 238 is vertically spaced no greater than 12 inches above the top surfaces of end portion 344 forming feet 350. In one implementation, ring 238 is at a height lower than the top height of tube 32. In other words, ring 238 is below top surfaces of tube 232. As a result, tube 232 covers at least portions of ring 238, reducing likelihood of impact with ring 238. In one implementation, ring 238 has an outer diameter of no greater than 48 inches.

In the example illustrated, ring 238 directly or indirectly abuts an interior surface of each of vertical portions 340 of poles 228. As shown by FIG. 17, in the example illustrated, the vertical portion 340 of each of poles 228 is fastened to ring 228. In the example illustrated, a fastener 360, in the form of a bolt, extends through pole 228 and through ring 238, where it is secured by a nut 362. In the example illustrated, a washer 364 may be disposed between a head of the bolt and pole 228. In some implementations, protective caps or covers may be positioned over portions of the fastener 360 and/or nut 362.

Although jumper 220 is illustrated as utilizing fasteners 364 securing ring 238 to each of poles 228, in other implementations, ring 238 may be secured each of poles 228 and other fashions. For example, ring 238 may be secured or joined to each of poles 228 by welding, adhesives, clips or other fastening or connection mechanisms. In some implementations, ring 238 may be integrally formed as a single integral unitary body with one or more of poles 228. Although ring 238 is illustrated as being a circular ring, ring 238 may have other annular shapes. For example, ring 238 may be a polygonal ring. Although ring 238 is illustrated as being annular (having a hollow or empty center), in other implementations, ring 238 may be the outer ring or edge of a perforate or imperforate disk or plate. In one implementation, ring 238 may support a circular platform a disk formed from a different material, wherein the circular platform or disk is mounted or rests upon ring 238. In some implementations, ring 238 may serve as a platform or base for supporting additional structures that project downwardly from ring 238 or that project vertically upward from ring 238 into the generally cylindrical empty void below cap 36 and surrounded by the vertical portions 340 of poles 228.

Figure 18:
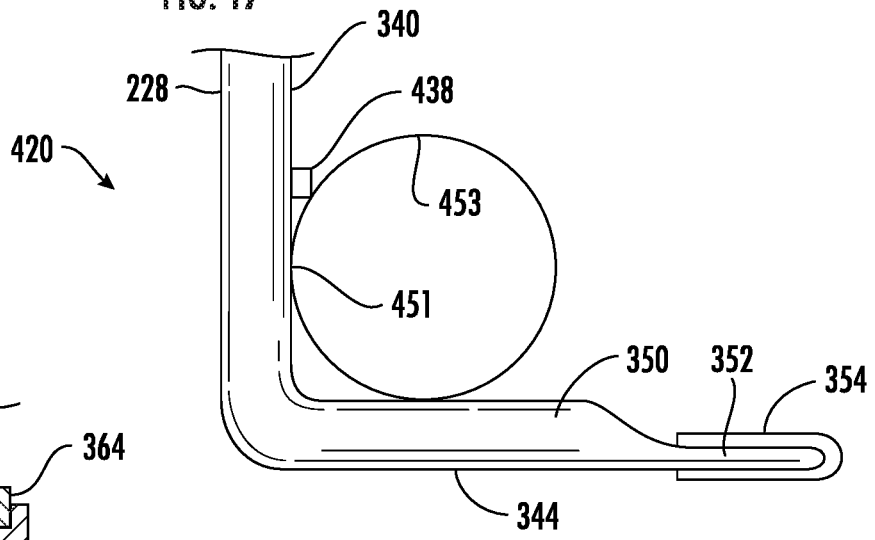
FIG. 18 is an enlarged fragmentary view of portions of an example jumper.

Although ring 238 is illustrated as extending along interior surface of each of vertical portion 340 of each of poles 228, in other implementations, ring 238 may encircle or otherwise extend about outer surfaces of each of vertical portion 340 of poles 228. Ring 228 may be connected to each of poles 228 while enclosing poles 228. FIG. 18 illustrates portions of an example jumper 420 which has a ring that encloses poles 228. Jumper 420 is similar to jumper 220 described above except that jumper 420 comprises ring 438 in place of ring 238. The remaining components of jumper 420 which corresponding points of jumper 220 are numbered similarly and/or are shown in FIG. 1-16.

Ring 438 extends on an outer side of the vertical portion 340 of each of poles 228. Ring 438 may be secured to the vertical portion 340 of each of poles 228 in a manner similar to the securement of ring 238 to each of poles 228. For example, ring 438 may be fastened, welded, clipped or otherwise joined to the vertical portion 340 of each of poles 228. Ring 438 may be circular or polygonal.

In the example illustrated in FIG. 18, ring 438 has an outer diameter greater than an inner diameter of tube 32 but sufficiently small so as to be recessed within the interior of tube 32, above the vertical midpoint 451 of tube 32 and below the apex 453 of tube 32. In such implementation, ring 438 may additionally serve to capture or retain tube down against feet 350. In one implementation, ring 438 is sufficiently recessed below apex 453 such that apex 453, when being flattened or compressed due to a person jumping on tube 32, remains sufficiently above ring 438 such that a person's feet do not contact ring 438.

Figure 19:
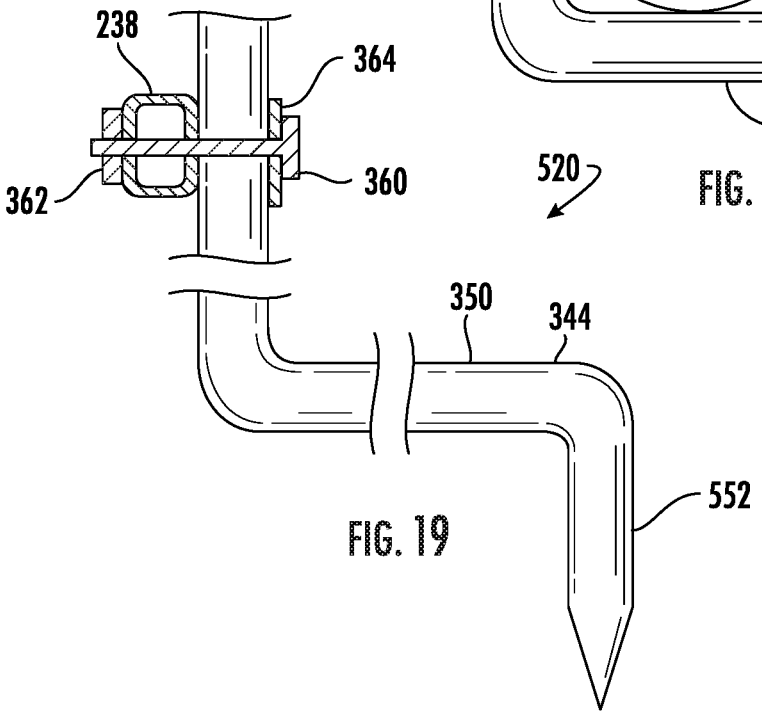
FIG. 19 is an enlarged fragmentary view of portions of an example jumper with selected portions shown in section.

FIG. 19 illustrate portions of an example jumper 520. Jumper 520 is similar to jumper 220 described above except that jumper 520 replaces flattened end portion 352 on each of feet 350 with a generally downwardly projecting spiked end portion 552. Those remaining components of jumper 520 which correspond to components of jumper 220 are numbered similarly and/or are shown in FIGS. 1-16.

Spiked end portions 552 extend generally perpendicular to or from feet 350. Spiked end portions 552 are to be pounded or otherwise driven into the underlying support surface, such as underlying ground. Spiked ends 552 may provide enhanced stabilization of jumper 520. In the example illustrated, spiked end portions 552 are integrally formed as a single unitary body with feet 350 and the remainder of poles 228. In other implementations, spiked end portions 552 may be separate components mounted, fastened, welded or otherwise joined to feet 350.

In each of the above example implementations, end portions 344, forming feet 350, are illustrated as being integrally formed as a single unitary body with vertical portion 340 of each of poles 228. In other implementations, and portions 344 and the formed feet 350 may comprise separate components which are fastened, welded, mounted or otherwise joined to the vertical portions 340 of each of poles 228. In some implementations, feet 350 may have a generally flat cross-sectional shape or profile.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A jumper apparatus comprising:

a ring;

a set of poles along the ring, each pole of the set of poles having a first axial end portion inwardly extending towards a centerline of the ring, a second axial end portion outwardly extending away from the centerline of the ring and a vertical portion connecting the first axial end portion and the second axial end portion, wherein the ring is vertically located between the first axial end portion and the second axial end portion of each pole; and a pneumatic tube extending about the set of poles over the second axial end portion of each pole, wherein the second axial end portion of each pole of the set of poles has a flat terminal end.

2. The jumper apparatus of claim 1 wherein the vertical portion of each of the poles extends parallel to the vertical portion of each pole of the set of poles and wherein the vertical portion of each pole abuts an exterior of the ring.

3. The jumper apparatus of claim 1, wherein the pneumatic tube has a top surface above the second axial end portion of each pole of the set of poles and wherein the ring is vertically between the top surface and the second axial end portion of each pole.

4. The jumper apparatus of claim 1, wherein the vertical portion of each pole of the set of poles has an axial midpoint between the first axial end portion of each pole of the set of poles and the second axial end portion of each pole of the set of poles and wherein the ring is vertically between the axial midpoint and the second axial end portion of each pole of the set of poles.

5. The jumper apparatus of claim 1, wherein the vertical portion of each pole of the set of poles is directly fastened to the ring.

6. The jumper apparatus of claim 1, wherein the vertical portion of each pole of the set of poles extends along an exterior of the ring.

7. The jumper apparatus of claim 1, wherein the ring is annular.

8. The jumper apparatus of claim 1 further comprising a cap securing the first axial end portions of the poles about the centerline.

9. The jumper apparatus of claim 8, wherein the cap comprises:

a lower plate extending parallel to the ring below the first axial end portion of each pole of the set of poles;

an upper plate extending parallel to the ring above the first axial end portion of each pole of the set of poles.

10. The jumper apparatus of claim 9, wherein the lower plate and the upper plate are joined by fasteners extending through the first axial end portion of each pole of the set of poles.

11. The jumper apparatus of claim 9, wherein at least one of the lower plate and the upper plate comprises radially extending grooves receiving the first axial end portion of each pole of the set of poles.

12. The jumper apparatus of claim 11, wherein the radially extending grooves underlie the first axial end portion of each pole of the set of the poles.

13. The jumper apparatus of claim 11, wherein the radially extending grooves overlie the first axial end portion of each pole of the set of poles.

14. The jumper apparatus of claim 1, wherein the first axial end portion of each pole of the set of poles comprises a flattened end.

15. The jumper apparatus of claim 1, wherein the set of poles comprises at least six poles.

16. The jumper apparatus of claim 1, wherein the second axial end portion of each pole extends in a plane parallel to the ring.

17. The jumper apparatus of claim 1, wherein the second axial end portion of each pole radially extends in a direction away from the centerline of the ring and has a length of at least 12 inches.

18. A jumper apparatus comprising:

a ring;

a set of poles along the ring, each pole of the set of poles having a first axial end portion inwardly extending towards a centerline of the ring, a second axial end portion outwardly extending away from the centerline of the ring and a vertical portion connecting the first axial end portion and the second axial end portion, wherein the ring is vertically located between the first axial end portion and the second axial end portion of each pole; and a pneumatic tube extending about the set of poles over the second axial end portion of each pole, wherein the second axial end portion of each pole has a vertical spike.

19. A jumper apparatus comprising:

a ring;

a set of poles along the ring, each pole of the set of poles having a first axial end portion inwardly extending towards a centerline of the ring, a second axial end portion outwardly extending away from the centerline of the ring and a vertical portion connecting the first axial end portion and the second axial end portion, wherein the ring is vertically located between the first axial end portion and the second axial end portion of each pole; and a pneumatic tube extending about the set of poles over the second axial end portion of each pole; and a cap securing the first axial end portions of the poles about the centerline, wherein the cap comprises:

a lower plate extending parallel to the ring below the first axial end portion of each pole of the set of poles; and an upper plate extending parallel to the ring above the first axial end portion of each pole of the set of poles.

20. The jumper apparatus of claim 19, wherein the lower plate and the upper plate are joined by fasteners extending through the second axial end portion of each pole of the set of poles.

* * * * *